US006296542B1

(12) United States Patent
Yearick

(10) Patent No.: US 6,296,542 B1
(45) Date of Patent: Oct. 2, 2001

(54) TOY

(76) Inventor: David Yearick, 50 Rocky Creek Rd., Greenville, SC (US) 29615

( * ) Notice: Subject to any disclaimer, the term of this patent is extended or adjusted under 35 U.S.C. 154(b) by 0 days.

(21) Appl. No.: 09/543,804

(22) Filed: Apr. 6, 2000

(51) Int. Cl.[7] ..... A63H 1/06
(52) U.S. Cl. ..... 446/246; 446/247; 446/236
(58) Field of Search ..... 446/236, 246, 446/247, 253, 254, 266, 490, 491

(56) References Cited

U.S. PATENT DOCUMENTS

| | | | | |
|---|---|---|---|---|
| 320,202 | * | 6/1885 | Zuydhoek . | |
| 1,141,434 | | 6/1915 | Tosta . | |
| 1,241,000 | * | 9/1917 | Mulvey . | |
| 1,932,943 | | 10/1933 | Smith | 46/37 |
| 2,032,871 | | 3/1936 | Dammeyer | 46/1 |
| 3,107,094 | | 10/1963 | Kfoury | 273/95 |
| 3,131,506 | * | 5/1964 | Fox . | |
| 3,135,066 | * | 6/1964 | Scherer . | |
| 3,325,940 | | 6/1967 | Davis | 46/228 |
| 3,439,446 | | 4/1969 | Alonso | 46/51 |
| 3,545,126 | * | 12/1970 | Brown . | |
| 3,605,327 | * | 9/1971 | Jones . | |
| 3,964,189 | | 6/1976 | Belokin, Jr. | 40/33 |
| 5,148,769 | * | 9/1992 | Zelinger | 119/29 |
| 5,209,692 | | 5/1993 | Coleman et al. | 446/71 |
| 5,941,196 | * | 8/1999 | Domanski | 119/708 |
| 5,947,790 | * | 9/1999 | Gordon | 446/247 |

* cited by examiner

*Primary Examiner*—Kien T. Nguyen
(74) *Attorney, Agent, or Firm*—Flint & Kim, P.A.

(57) ABSTRACT

A hand held toy having a power source with a rotating shaft. A crank is connected with an end of the shaft and extends radially therefrom. An elongated flexible member is connected with the crank at a location radially spaced from its axis. An anchor member is connected with an opposite end of the elongated member and is adapted to control that end of the member. In use, rotation of the shaft causes the elongate member to form controlled substantially uniform convolutions and, selective relative movement between the power source and anchor causes the convolutions to form into varying controlled sizes and shapes.

2 Claims, 2 Drawing Sheets

TOY

BACKGROUND OF THE INVENTION

The instant invention is directed to a toy which is adapted to rotate a segmented string which can be formed into various convoluted forms.

Various devices, some of which are toys, are adapted to rotate flexible strips or strings to form convoluted figures. Certain numbers of these devices are illustrated in U.S. Pat. Nos. 1,141,434; 3,107,094; 3,439,446; 3,964,189. None of the cited devices has the capability or the intent to form varying size and configurated convoluted figures as does the toy of the invention.

Accordingly, it is an object of the invention of provide a toy of simple and inexpensive construction.

Another object of the invention is a toy which is capable of forming an indeterminate member of varying shapes and forms of convoluted configurations dependent upon the skill of the user.

Another object of the invention is the provision of a power driven hand held toy.

Another object of the invention is the provision of a toy which finds use with a wide range of ages.

SUMMARY OF THE INVENTION

The invention is directed to a toy which is comprised of a hand held drive having a shaft which rotates about an axis and a crank connected with an end of the shaft and extending radially therefrom. An elongated flexible member is connected at one end with the crank at a location radially spaced from the axis and an anchor member is connected with an opposite end of the elongated flexible member. The anchor member is adapted to control -the position of the elongate flexible member during operation of the toy.

The drive is preferably comprises an electric motor carried in a plastic housing which is in preferably the form of a pistol grip. Controls are provided which actuate, deactivate and vary the RPM's of the electric motor. These controls include an on/off button and a rheostat slide. The housing also carries a battery or batteries which are the power source for the electric motor and may drive it to speeds which may vary between 100 and 10,000 RPM's.

The elongate flexible member preferable comprises a segmented string The elongate member is preferable between 6" and 36" in length.

The crank comprises a circular wheel which is mounted along its axis of rotation with the end of the shaft. An end of the elongated flexible member is connected with the wheel adjacent its periphery. The anchor may comprise one of many objects such as a suction cup, a ball or a star burst.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Referring now in more detail to the drawings, the invention will now be described in more detail.

Figure 1:
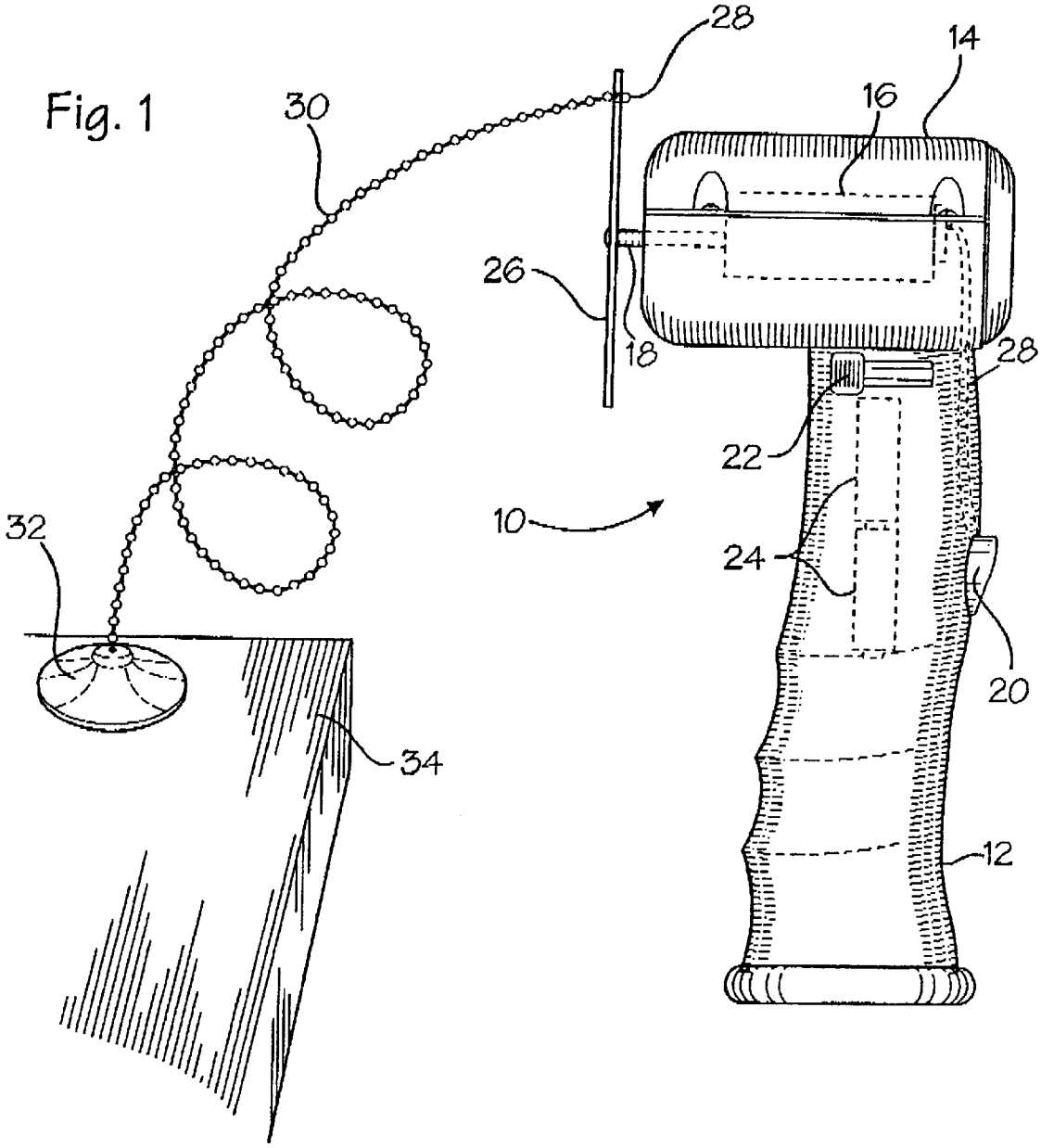
FIG. 1 is a perspective view of the toy in use with a suction cup.
Figure 2:
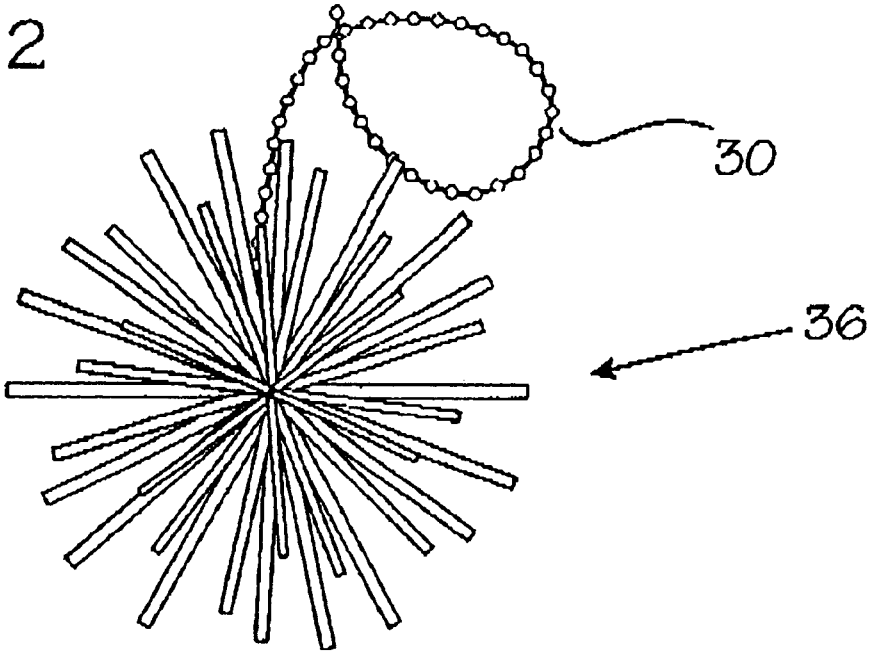
FIG. 2 is a section view of an exploded star or a second form of anchor; and, FIG. 3 is a section view of a ball as a third form of anchor.
Figure 3:
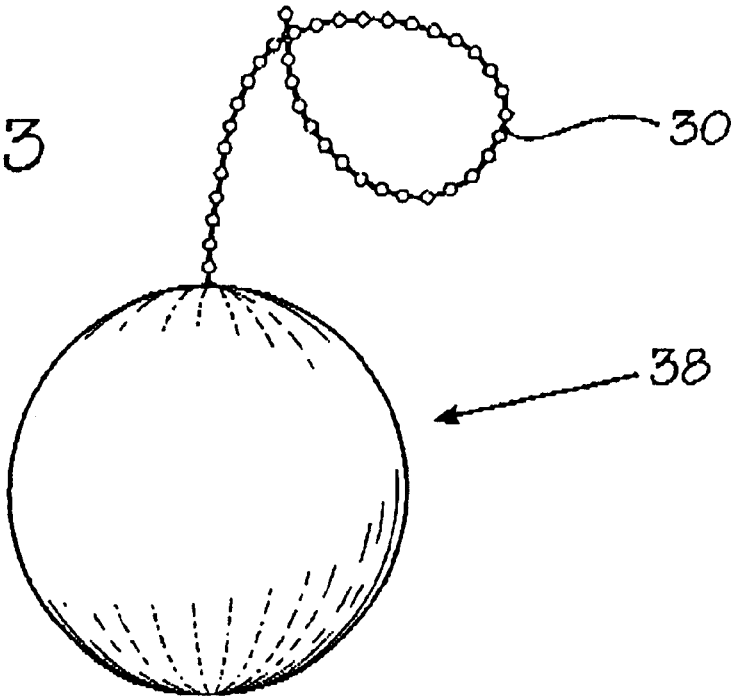

Turning now to the drawings, FIG. 1 shows, the toy of the invention while FIGS. 2 and 3 show alternative anchor members which may be attached to the elongated flexible member.

The toy includes housing 10 which is configured generally in the form of a pistol grip. Housing 10 includes handle 12 which mounts motor compartment 14 at one end thereof. An electric motor 16 which includes drive shaft 18 is mounted within the motor compartment with shaft 18 extend outwardly of the housing.

An on/off switch 20 along with a rheostat 22 are preferably positioned on grip 12 which also houses the power source for motor 16. Preferably, the power source comprises one or more electric batteries 24 which connect through circuitry 28 with motor 16 by way of switch 20 and rheostat 22.

A crank, preferably in the form of wheel 26, is connected along its axis to an end of drive shaft 18. Adjacent the periphery of wheel 26 a catch 28 is provided. Preferably wheel 26 is about 1" in diameter although this may vary between ½" and 2½". Any type of structure which spaces a catch radially from the axis of rotation of shaft 18 could function as the crank.

A segmented chain of metal balls 30 is connected in fixed position at one end with wheel 26 by catch 28. The opposite end of chain 30 connects in a fixed position with an anchor, which in FIG. 1 is a suction cup 32. The anchor may take other shapes, examples of which are star burst 36 as shown in FIG. 2 or ball 38 as shown in FIG. 3.

Preferably motor 16 is capable of developing RPM's of between 100 and 10,000. The device will operate very nicely, however, with the motor running at about 175 RPM's.

The chain of metal balls may be between 6" and 36" long, however about 24" is the preferred length.

In use, pistol grip 12 is held in one hand and motor 16 is activated. This causes wheel 26 to move the end of chain 30 about its axis of rotation. This movement causes convolutions to be formed in the chain along its length. By anchoring the opposite end of chain 30 in fixed position by securing suction cup 32 with a fixed surface such as shown at 34 or by gripping star burst 36 or ball 38 in the other hand the shapes of the convolutions may be altered on demand. Relative movement, i.e., toward, away and varying axial positions, between opposite ends of chain 30 causes the convoluted shapes being formed to vary in size and shape. The skill level developed by the user determines the limits of the variations in size and shape of the convolutions.

It is noted that the selected shape of housing 10 may vary substantially from the preferred pistol grip shape. Also, the power source driving shaft 18 could comprise something other than an electric motor.

While a preferred embodiment of the invention has been described using specific terms, such description is for illustrative purposes only, and it is to be understood that changes and variations may be made without departing from the spirit or scope of the following claims.

What is claimed is:

1. A toy comprising:

a drive including a hand held housing containing an electric motor connected with a power source which is operative to drive said motor and a control including an on/off switch and a rheostat which is operative to activate, deactivate and control said motor to rotate in a single direction at between 100 and 10,000 RPM's;

said motor including a drive shaft extending outwardly of said housing;

a wheel having a diameter greater than 1" connected along its axis of rotation with said drive shaft;

a segmented string of metal balls connected at one end with said wheel at a point adjacent its periphery;

an anchor comprising a suction cup connected with an opposite end of said segmented string of metal balls, said anchor maintaining said opposite end secured with a fixed surface; whereby, upon activation of said motor combined with movement of said housing relative to said anchor said segmented string of metal balls is caused to move through patterns in space of varying sizes and shapes.

2. The toy of claim 1 wherein said segmented string of metal balls is between 6" and 36" in length.

* * * * *